US009676186B2

(12) United States Patent
Taff

(10) Patent No.: US 9,676,186 B2
(45) **Date of Patent: *Jun. 13, 2017**

(54) FLUID EJECTION DEVICE WITH MIXING BEADS

(71) Applicant: Hewlett-Packard Development Company, L.P., Houston, TX (US)

(72) Inventor: Brian M. Taff, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 6 days.

This patent is subject to a terminal disclaimer.

(21) Appl. No.: 15/155,480

(22) Filed: May 16, 2016

(65) Prior Publication Data

US 2016/0257116 A1 Sep. 8, 2016

Related U.S. Application Data

(63) Continuation of application No. 14/765,180, filed as application No. PCT/US2013/024018 on Jan. 31, 2013, now Pat. No. 9,375,928.

(51) Int. Cl.

| | |
|---|---|
| ***B01F 13/00*** | (2006.01) |
| ***B41J 2/14*** | (2006.01) |
| ***B01F 11/00*** | (2006.01) |
| ***B01F 13/08*** | (2006.01) |

(52) U.S. Cl.

CPC ..... *B41J 2/14* (2013.01); *B01F 11/0082* (2013.01); *B01F 13/0006* (2013.01); *B01F 13/0818* (2013.01); *B41J 2/1433* (2013.01)

(58) Field of Classification Search

CPC . B41J 2/1433; B01F 13/0006; B01F 13/0818; B01F 11/0082; B01F 11/0091

See application file for complete search history.

(56) References Cited

U.S. PATENT DOCUMENTS

| | | | | |
|---|---|---|---|---|
| 5,352,036 | A * | 10/1994 | Haber | A61J 1/065 206/219 |
| 6,126,904 | A | 10/2000 | Zuellig et al. | |
| 7,407,631 | B2 * | 8/2008 | Swon | B01F 11/0082 366/273 |
| 7,832,839 | B2 | 11/2010 | McCabe et al. | |
| 9,375,928 | B2 * | 6/2016 | Taff | B41J 2/1433 |
| 2005/0150424 | A1 | 7/2005 | Kasai | |
| 2005/0259132 | A1 | 11/2005 | Koguchi et al. | |
| 2008/0100677 | A1 | 5/2008 | Boyer | |
| 2008/0129803 | A1 | 6/2008 | McCabe et al. | |
| 2010/0085405 | A1 | 4/2010 | Indorsky et al. | |

FOREIGN PATENT DOCUMENTS

| | | |
|---|---|---|
| JP | 10086402 | 4/1998 |
| TW | 200911549 | 3/2009 |
| TW | 200911549 A | 3/2009 |

OTHER PUBLICATIONS

PCT Search Report and Written Opinion, mailed Oct. 7, 2013, 10 pgs.

* cited by examiner

*Primary Examiner* — Anh T. N. Vo
(74) *Attorney, Agent, or Firm* — HP Inc.—Patent Department

(57) ABSTRACT

In an embodiment, a fluid ejection device includes a die substrate with a chiclet adhered by its front side to the die substrate. The fluid ejection device also includes an ink delivery slot formed through the chiclet from its back side to its front side. The fluid ejection device further includes a mixing bead at the back side of the chiclet, adjacent the ink delivery slot.

15 Claims, 6 Drawing Sheets

FLUID EJECTION DEVICE WITH MIXING BEADS

CROSS-REFERENCE TO RELATED APPLICATIONS

This application is a Continuation of copending U.S. patent application Ser. No. 14/765,180, filed on Jul. 31, 2015, and incorporated herein by reference in its entirety, which claims priority to International Application Serial No. PCT/US2013/024018, filed Jan. 31, 2013, and incorporated herein by reference in its entirety.

BACKGROUND

Inkjet printheads are non-contact fluid ejection devices that eject ink from printhead nozzles onto a media substrate (e.g. paper) to form an image. Thermal inkjet printheads eject drops from a nozzle by passing electrical current through a heating element to generate heat and vaporize a small portion of the fluid ink within a firing chamber. Piezoelectric inkjet printheads use a piezoelectric material actuator to generate pressure pulses that force ink drops out of a nozzle. While both dye-based and pigment-based inks are used in inkjet printheads, properties such as color, jettability, drying time, long term storage stability, and decap time (the amount of time a printhead can be left uncapped and idle and can still fire ink droplets properly), influence which type of ink is used in a particular printhead.

Pigment-based inks are increasingly used over dye-based inks because of the various advantages they provide, such as color strength and water fastness. Pigment particles are larger and remain in suspension rather than dissolving in liquid. This provides greater color intensity as the pigment inks remain more on the surface of the paper instead of soaking into the paper. Pigment inks also tend to be more durable and permanent than dye inks. For example, pigment inks smear less than dye inks when they encounter water.

Unfortunately, pigments (colorant particles) suspended in the ink vehicle/carrier tend to settle when a printhead is not used for an extended period of time. Pigment settling can cause printhead nozzles to clog, which reduces the overall print quality.

BRIEF DESCRIPTION OF THE DRAWINGS

The present embodiments will now be described, by way of example, with reference to the accompanying drawings, in which.

DETAILED DESCRIPTION

Overview

Figure 1A:
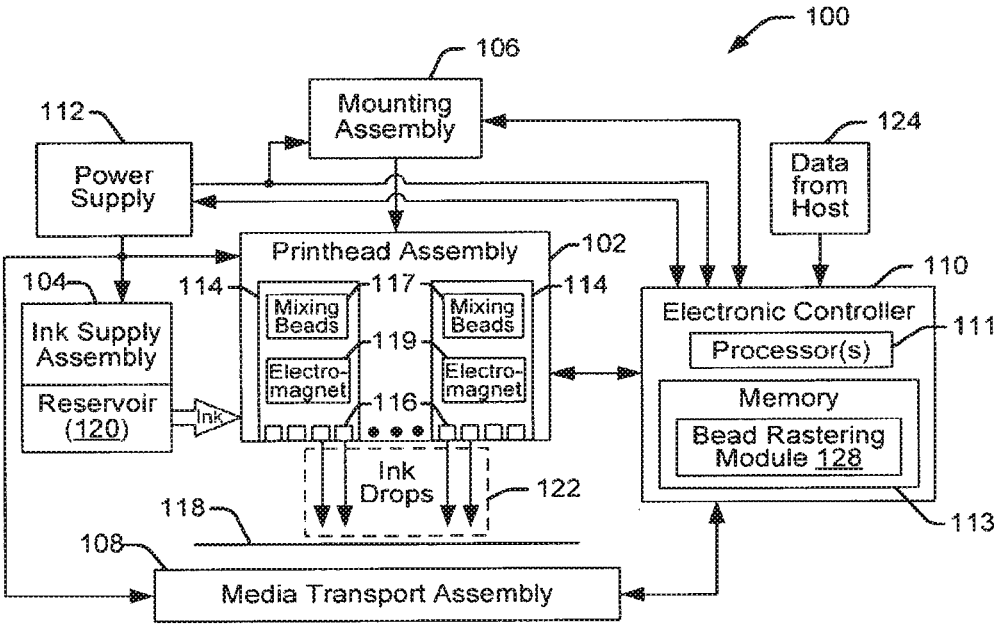
FIG. 1*a* shows a fluid ejection system implemented as an inkjet printing system, according to an embodiment.

As noted above, while the use of pigment-based inks in inkjet printheads provides certain advantages, there are also challenges with their use. When there are extended periods of time when a printhead is inactive, high pigment load and/or settling-prone inks demonstrate a settling dynamic referred to as PIVS (Pigment Ink Vehicle Separation) that can alter the local composition of ink volumes within the printhead nozzles, firing chambers, and in some cases, beyond an inlet pinch toward the shelf/trench (ink slot) interface. In addition to PIVS, an evaporation-driven "thickening" or "hardening" of ink can occur within the bore/nozzle (and in some cases within the chamber as well) due to the depletion of in-ink water molecules and the subsequent elevation in the local ink viscosity. Following periods of nozzle inactivity, the variation in properties of these localized volumes can modify drop ejection dynamics (e.g., drop trajectories, velocities, shapes and colors). When printing resumes after an inactive, non jetting period, there is an inherent delay before the local ink volumes within the nozzle bores are refreshed. This delay, and the associated effects on drop ejection dynamics following a non-jetting period, can be collectively referred to as decap response.

Prior methods of mitigating decap response have focused mostly on ink formulation chemistries, minor architecture adjustments, tuning nozzle firing parameters, and/or servicing algorithms. These approaches have often been directed toward specific printer/platform implementations, however, and have therefore not provided a universally suitable solution.

Efforts to mitigate the decap response through adjustments in ink formulation, for example, often rely on the inclusion of key additives that offer benefits only when paired with specific dispersion chemistries. Architecture focused strategies have typically leveraged shortened shelves (i.e., the length from the center of the firing resistor to the edge of the incoming ink-feed slot), the inclusion or exclusion of counter bores, and modifications to resistor sizes. These techniques, however, usually provide only minimal performance gains. Fire pulse routines have shown some improvements in targeted architectures when exercised as sub-TOE (turn on energy) mixing protocols for stirring ink within the nozzle to combat PIVS forms of the decap dynamic, or by delivering more energetic stimulation of in-chamber ink volumes (delivered at higher voltages or through modified precursor pulse configurations) to compete against viscous plugging forms of the decap response. Again, however, this strategy provides only marginal gains in specific non-universal contexts. Servicing algorithms have functioned as the main systems-based fix. However, servicing algorithms typically generate waste ink and associated waste ink storage issues, in-printer aerosol, and print/wipe protocols that are only feasible for implementation as pre- or post-job exercises.

Another technique for mitigating decap response issues involves "outrunning" the settling and thickening of ink through continued printing. This technique is often a viable choice in high-throughput applications where a printer (e.g., a large format, fixed printbar printing system) is heavily utilized in a consistent and regular way. Unfortunately, it is not always the case that such use modes can be expected, and the penalties associated with settling-prone inks increase significantly as other use modes are employed.

More recent solutions include nozzle-level micro-recirculation strategies, as well as macro-recirculation strategies that focus on stimulating fluid flow behind the back-side of the printhead die. Challenges with micro-recirculation designs include difficulties in homogenizing ink volumes that are upstream of the printhead die, which unfortunately can permit pigment settling in other regions of the printhead that are important for delivering fresh ink. Conversely, challenges with macro-recirculation designs often include pigment settling in smaller regions and regions where the flow follows sharp turns within the printhead. Once settling begins in such areas, it can cascade into other parts of the ink delivery system.

Embodiments of the present disclosure provide significant improvement over prior efforts to mitigate decap response issues, especially with regard to the complex issue of PIVS (Pigment Ink Vehicle Separation) associated with high pigment load and/or settling-prone inks. A printhead fluid ejection device includes bead-like structures such as ball bearings in the ink delivery system (IDS) immediately upstream of the chiclet die carrier. Periodically rastering these mixing beads back and forth along the elongated axis of the chiclet ink delivery slots (one bead per slot) disrupts the settling dynamic and subsequent nozzle fouling complications typically observed with such inks. Entrainment effects of the rastering beads create a mixing dynamic that can re-suspend settled pigments. The beads operate to mix fluid down to regions of the die close to the jetting nozzles, and can also introduce mixing flows that propagate effectively into the larger upstream IDS geometry. The rastering response can be implemented, for example, through the use of small electromagnets positioned within the printhead at opposing ends of the chiclet ink delivery slots. Metal (e.g., ferrous-core) beads can be rastered by actuating the electromagnets at opposing ends of the chiclet, 180 degrees out of phase. The coupling between the beads and the magnetic field can be amplified (made stronger) by using a magnet as the bead. In this case, the electromagnets at each end of the chiclet slot can work in combination, and simultaneously, with an electromagnet at one end of the slot pushing the bead magnet away while the electromagnet at the other end of the slot draws the bead magnet near. In a further implementation, a single electromagnet on one end of the chiclet can perform the rastering of a bead magnet by shifting its polarity through current reversal through the coil. Such a configuration enables this technology to more easily fit into varying printhead form factors.

In an example embodiment, a fluid ejection device includes a die substrate. A chiclet is adhered to the die substrate at its front side. An ink delivery slot is formed through the chiclet from its back side to its front side. A mixing bead is installed at the back side of the chiclet, adjacent the ink delivery slot. In other embodiments, the fluid ejection device includes an electromagnet to raster the bead back and forth across the ink delivery slot.

In another example embodiment, a processor-readable medium stores code representing instructions that when executed by a processor cause the processor to turn on first and second electromagnets in a fluid ejection device to raster a mixing bead back and forth across an ink delivery slot, wherein the first electromagnet is located at a first side of the ink delivery slot and the second electromagnet is located at a second side of the ink delivery slot.

In another example embodiment, a processor-readable medium stores code representing instructions that when executed by a processor cause the processor to turn on a single electromagnet located at a first side of an ink delivery slot in a fluid ejection device, such that the single electromagnet has a first polarity, and turn on the single electromagnet such that the single electromagnet has a reverse polarity.

Illustrative Embodiments

FIG. 1*a* illustrates a fluid ejection system implemented as an inkjet printing system 100, according to an embodiment of the disclosure. Inkjet printing system 100 generally includes an inkjet printhead assembly 102, an ink supply assembly 104, a mounting assembly 106, a media transport assembly 108, an electronic controller 110, and at least one power supply 112 that provides power to the various electrical components of inkjet printing system 100. In this embodiment, fluid ejection devices 114 are implemented as fluid drop jetting printheads 114. Inkjet printhead assembly 102 includes at least one fluid drop jetting printhead 114 that ejects drops of ink through a plurality of orifices or nozzles 116 toward print media 118 so as to print onto the print media 118. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies. Mylar, and the like. As further discussed below, each printhead 114 comprises one or more mixing beads 117 and electromagnets 119 that function in varying implementations to effect a disruption of a PIVS settling dynamic that maintains and/or restores local ink volumes within the printhead fluid ejection device according to their natural suspended compositions.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

Figure 1B:
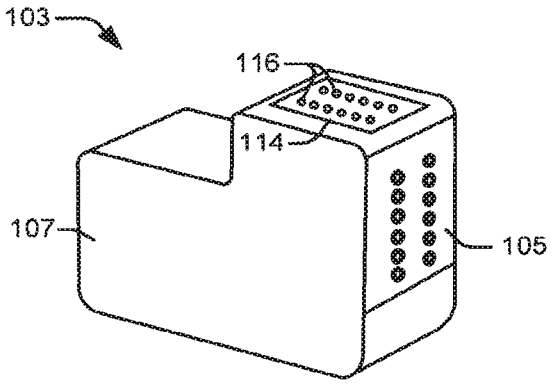
FIG. 1*b* shows a perspective view of an example inkjet cartridge that includes an inkjet printhead assembly and ink supply assembly, according to an embodiment.

In some implementations, as shown in FIG. 1*b*, inkjet printhead assembly 102 and ink supply assembly 104 (including reservoir 120) are housed together in a replaceable device such as an integrated inkjet printhead cartridge or pen 103. FIG. 1*b* shows a perspective view of an example inkjet cartridge 103 that includes inkjet printhead assembly 102 and ink supply assembly 104, according to an embodiment of the disclosure. In addition to one or more printhead dies 114, inkjet cartridge 103 includes electrical contacts 105 and an ink (or other fluid) supply chamber 107. Electrical contacts 105 carry electrical signals to and from controller 110, for example, to cause the ejection of ink drops through nozzles 116. Cartridge 103 can have a single supply chamber 107 that stores one color of ink, or a number of chambers 107 that each store a different color of ink. In some implementations, a larger reservoir may also be located separately from the cartridge 103 to refill the local chamber 107 through an interface connection, such as a supply tube. In various implementations, cartridge 103 and/or reservoir 120 of ink supply assembly 104 may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly. As such, mounting assembly 106 includes a carriage for moving inkjet printhead assembly 102 relative to media transport assembly 108 to scan print media 118. In another implementation, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

In one implementation, inkjet printhead assembly 102 includes one printhead 114. In another implementation, inkjet printhead assembly 102 is a wide-array assembly with multiple printheads 114. In wide-array assemblies, an inkjet printhead assembly 102 typically includes a carrier that carries printheads 114, provides electrical communication between the printheads 114 and electronic controller 110, and provides fluidic communication between the printheads 114 and ink supply assembly 104.

In one implementation, inkjet printing system 100 is a drop-on-demand thermal bubble inkjet printing system where the printhead(s) 114 is a thermal inkjet (TIJ) printhead. The TIJ printhead employs a thermal resistor ejection element in an ink chamber to vaporize ink and create bubbles that force ink or other fluid drops out of a nozzle 116. In another implementation, inkjet printing system 100 is a drop-on-demand piezoelectric inkjet printing system where the printhead(s) 114 is a piezoelectric inkjet (PIJ) printhead that implements a piezoelectric material actuator as an ejection element to generate pressure pulses that force ink drops out of a nozzle.

Electronic controller 110 typically includes one or more processors 111, firmware, software, one or more computer/processor-readable memory components 113 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic printer controller 110 controls inkjet printhead assembly 102 to eject ink drops from nozzles 116. Thus, electronic controller 110 defines a pattern of ejected ink drops that form characters, symbols, and/or other graphics or images on print media 118. The pattern of ejected ink drops is determined, for example, by the print job commands and/or command parameters from data 124.

In one implementation, electronic controller 110 includes a bead rastering module 128 stored in a memory 113 of controller 110. Bead rastering module 128 includes coded instructions executable by one or more processors 111 of controller 110 to cause the processor(s) 111 to implement various rastering routines to control electromagnets within a printhead 114 to effect the rastering back and forth of mixing beads 117 along the elongated axis of chiclet ink delivery slots within the printhead 114, as discussed more fully below.

Figure 2:
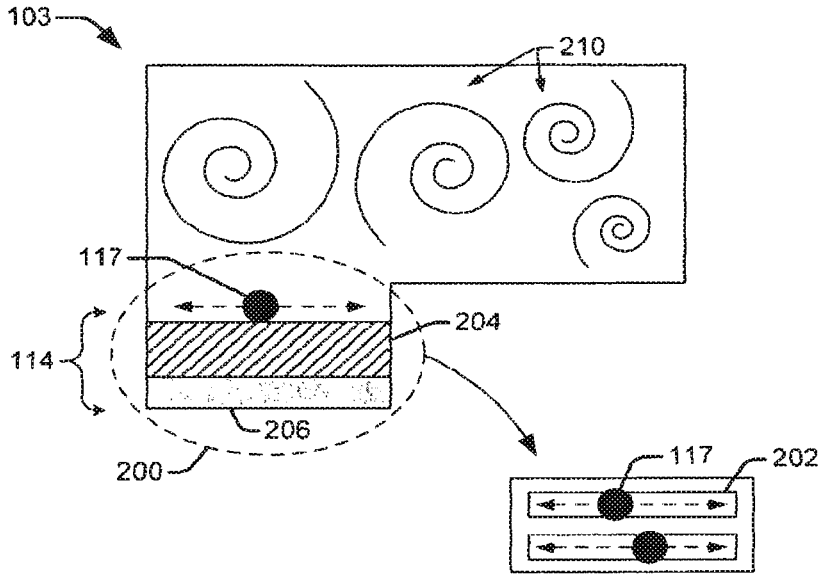
FIG. 2 shows a cross-sectional side view of an example inkjet cartridge that includes a printhead with mixing beads, according to an embodiment.
Figure 3:
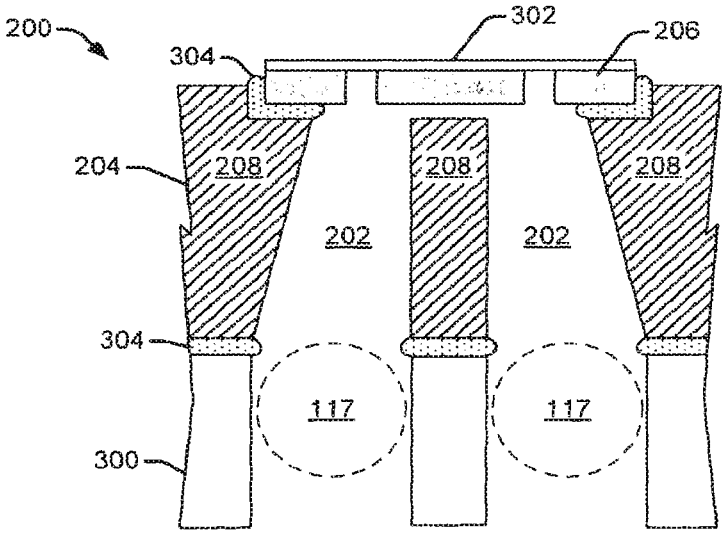
FIG. 3 shows a cross-sectional view of the printhead cutout from FIG. 2, according to an embodiment.

FIG. 2 shows a cross-sectional side view of an example inkjet cartridge 103 that includes a printhead 114 with mixing beads 117, according to an embodiment of the disclosure. FIG. 3 shows a cross-sectional view of the printhead 114 cutout 200 from FIG. 2. Referring to FIGS. 2 and 3, the mixing beads 117 are located in printhead 114 adjacent to ink delivery slots 202 (one bead per slot) on the back side of chiclet 204. In general, the beads are sized large enough that they cannot slip down into ink delivery slots 202 of the chiclet 204. As can be seen more clearly in FIG. 3, chiclet 204 is the printhead die substrate 206 carrier, and it includes carrier ribs 208 which define the chiclet ink delivery slots 202 (i.e., the fluid passageways within the chiclet). The chiclet 204 is a fluid distribution manifold such as a plastic fluidic interposer whose ink delivery slots 202 provide fluid passageways between the plastic housing 300 of cartridge 103 and the printhead die substrate 206. While only two slots 202 are illustrated and discussed, it should be apparent that the concepts disclosed herein apply equally to printhead configurations in which a chiclet has varying numbers of slots 202. The printhead substrate 206 is typically fabricated from a silicon or glass wafer through standard micro-fabrication processes such as electroforming, laser ablation, etching, sputtering, dry etching, photolithography, casting, molding, stamping, machining, and so on. The printhead substrate 206 is also further developed to include a fluidics and nozzle layer 302 on a top side of the substrate 206. Adhesive bonds 304 generally adhere substrate 206 to the carrier ribs 208 at the front side of chiclet 204, and adhere the back side of chiclet 204 to the plastic housing 300 of cartridge 103.

As beads 117 raster back and forth along the elongated axis of chiclet 204 ink delivery slots 202 within the printhead 114, they create a fluid mixing dynamic 210 that re-suspends pigments that have settled out of the fluid ink vehicle. The beads 117 operate to mix fluid down to regions of the substrate 206 close to the jetting nozzles 116 of nozzle layer 302, and can also introduce mixing flows that propagate effectively into the larger upstream IDS geometry within the plastic housing 300 of cartridge 103.

Figure 4:
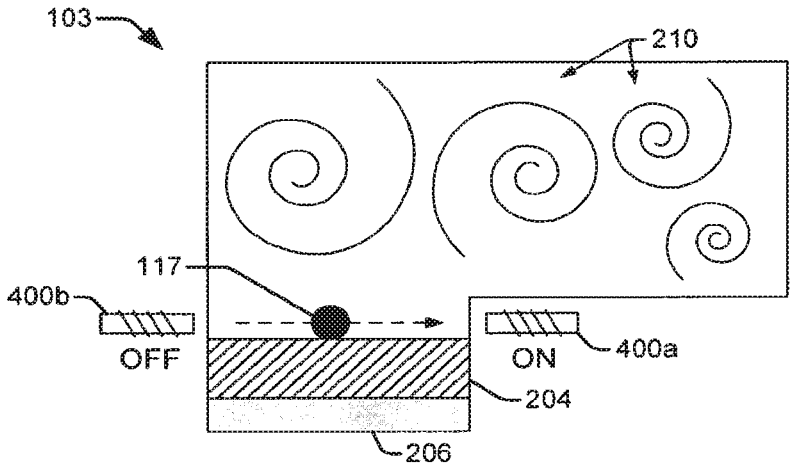
FIGS. 4 and 5 show cross-sectional side views of example inkjet cartridges where mixing beads are experiencing different bead rastering modes, according to embodiments.
Figure 5:
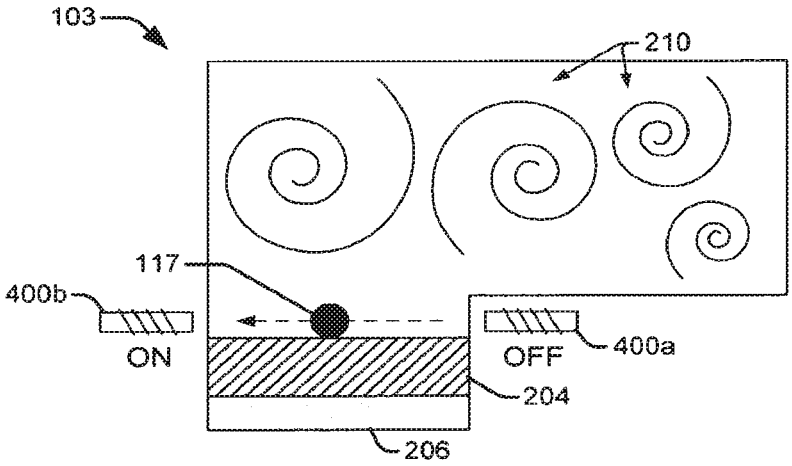

While moving the cartridge 103 back and forth (e.g., by shaking it manually) can effectively raster the beads 117 back and forth within the printhead 114 to achieve fluidic mixing, automated processes of rastering of the beads 117 are also possible. FIGS. 4 and 5 show a cross-sectional side view of an example inkjet cartridge 103 where the mixing beads 117 are experiencing different bead rastering modes, according to embodiments of the disclosure. In the implementations of FIGS. 4 and 5, the mixing beads 117 are metal beads, formed of a ferromagnetic material, such as ferrous-core beads. The beads 117 in FIGS. 4 and 5 can also be formed of other ferromagnetic materials such as nickel and cobalt. In addition, beads 117 may be coated with a protective layer that protects them from the corrosive effects of ink, such as a polymer layer.

Because beads 117 are formed of a ferromagnetic material, they are responsive to the forces of magnetic fields, which can attract and repel such materials. Accordingly, printhead 114 can be equipped with one or more electromagnets 400 positioned within the printhead 114 at opposing ends of the chiclet ink delivery slots 202. Electromagnets 400 generally comprise a coil of wire wrapped around a core of ferromagnetic material such as steel. An electromagnet 400 acts as a magnet when an electric current passes through the coil, and ceases acting as a magnet when the current stops. The ferromagnetic core around which the coil is wrapped enhances the magnetic field produced by the coil.

Electric current (e.g., from a power supply 112) passing through the coils of electromagnets 400 is controllable by a processor 111 executing instructions from a bead rastering module 128 stored in a memory 113. Thus, the processor 111 controls when the electromagnets 400 turn ON, and when they turn OFF, to control when and how the beads 117 are rastered back and forth across the ink delivery slots 202 of chiclet 204 within the printhead 114. For example, as shown in FIGS. 4 and 5, the processor 111 can raster the beads 117 back and forth by actuating the electromagnets 400 (400*a* and 400*b*) at opposing ends of the chiclet 204, 180 degrees out of phase with one another. In FIG. 4, an electromagnet 400*a* at one end of the chiclet 204 (i.e., on the right side) is turned ON by processor 111, which pulls the bead to the right, toward the electromagnet 400*a*. At this time, the electromagnet 400*b* (i.e., on the left side) is OFF. This raster mode allows the bead(s) 117 to move to the right and traverse the length of the slot 202. Thereafter, as shown in FIG. 5, the electromagnet 400*b* at the other end of the chiclet 204 (i.e., on the left side) is turned ON by processor 111, while the electromagnet 400*a* is turned OFF. This raster mode pulls the bead(s) 117 back across the slot 202 to the left, toward the electromagnet 400*b*.

In another implementation of the printhead 114 configuration shown in FIGS. 4 and 5, the beads 117 can be magnets. That is, the beads 117 are formed of material that is magnetized and creates its own persistent magnetic field. When beads 117 are magnets, the magnetic coupling between the beads 117 and electromagnets 400 is amplified. By the processor 111 alternately shifting the polarity of the electromagnets 400 through reversing the direction of current through the coils, the electromagnets 400 at each end of the slot 202 can work simultaneously and in combination to move the beads 117 back and forth across the slots 202. That is, for example, while electromagnet 400*a* is ON in one polarity (e.g., a positive polarity), electromagnet 400*b* is ON in the reverse polarity (e.g., a negative polarity). In this mode, electromagnet 400*a* will pull magnetic bead 117 to the right, while electromagnet 400*b* pushes magnetic bead 117 to the right. After the magnetic bead 117 reaches the right side of the slot 202, processor 111 can control a reversal of the direction the current flows through the coils of electromagnets 400*a* and 400*b*, thereby reversing their polarities. In this mode, electromagnet 400*a* will push magnetic bead 117 to the left, while electromagnet 400*b* pulls magnetic bead 117 to the left.

Figure 6:
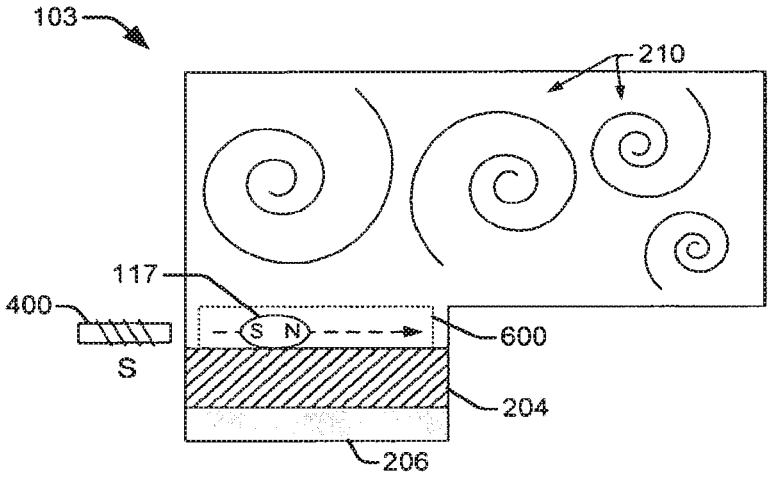
FIGS. 6 and 7 show cross-sectional side views of example inkjet cartridges where magnetic mixing beads are experiencing different bead rastering modes using a single electromagnet, according to embodiments.
Figure 7:
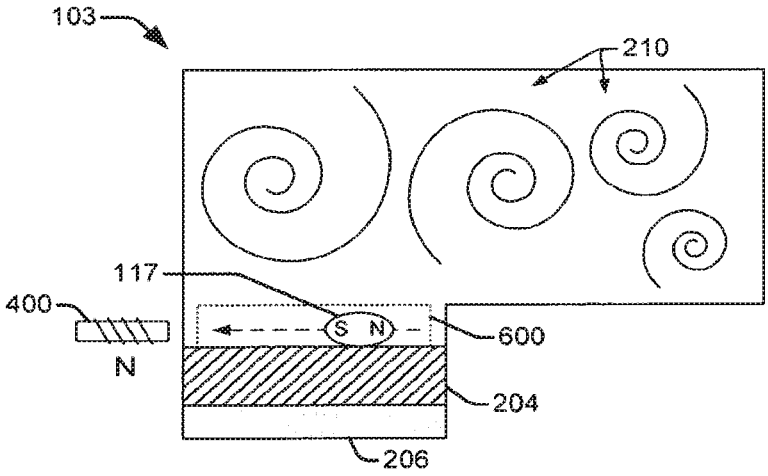

FIGS. 6 and 7 show a cross-sectional side view of an example inkjet cartridge 103 where magnetic mixing beads 117 are experiencing different bead rastering modes using a single electromagnet, according to embodiments of the disclosure. In the implementations of FIGS. 6 and 7, the mixing beads 117 are formed of magnetized material, such that they create their own magnetic fields. Materials that can be magnetized include, for example, various ferromagnetic materials such as iron, nickel, cobalt, some metal alloys, and some naturally occurring minerals such as lodestone.

The bead rastering modes illustrated in FIGS. 6 and 7 are achieved with the use of a single electromagnet 400 on one end of the chiclet 204 ink delivery slots 202. The polarity of the single electromagnet 400 is alternately shifted through current reversal through the coil. As shown in FIG. 6, a barrier 600 in the printhead 114 maintains the orientation of the polarized magnetic bead 117. In the raster mode show in FIG. 6, the processor 111 controls current flow through the coil of electromagnet 400 so that it generates a south (S) polarized magnetic field. The magnetic bead 117 is oriented such that its south (S) pole is toward the electromagnet 400, which causes the electromagnet 400 to repel the magnetic bead 117, moving it toward the right side of the slot 202. In the raster mode show in FIG. 7, the processor 111 reverses the direction of current flow through the coil of electromagnet 400 so that it generates a north (N) polarized magnetic field. Because the magnetic bead 117 is oriented such that its south (S) pole is toward the electromagnet 400, the electromagnet 400 pulls on the magnetic bead 117, moving it toward the left side of the slot 202. The use of a single electromagnet 400 to raster the magnetic beads 117 back and forth across the chiclet slots 202 improves the likelihood that such technology can be fit into additional printhead form factors that have tighter space restrictions.

Figure 8:
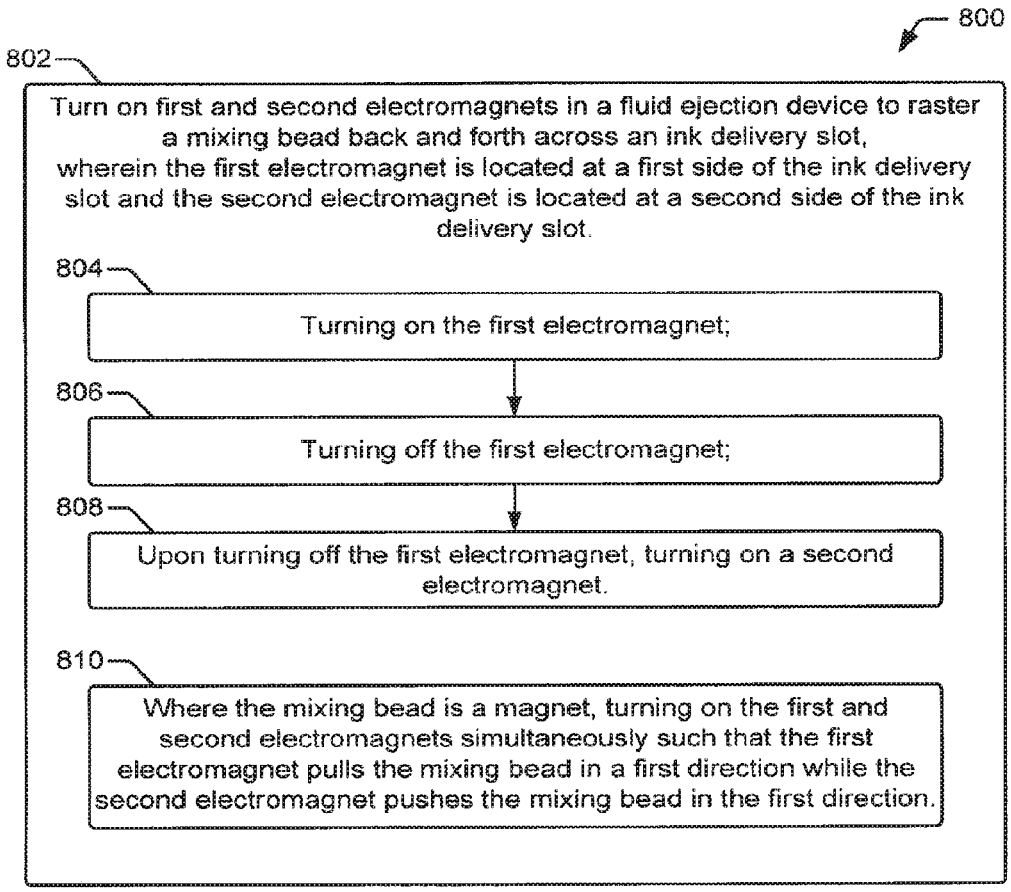
FIGS. 8 and 9, show flowcharts of example methods related to a fluid ejection device with mixing beads and electromagnets that function to disrupt pigment settling within the printhead fluid ejection device, according to embodiments.
Figure 9:
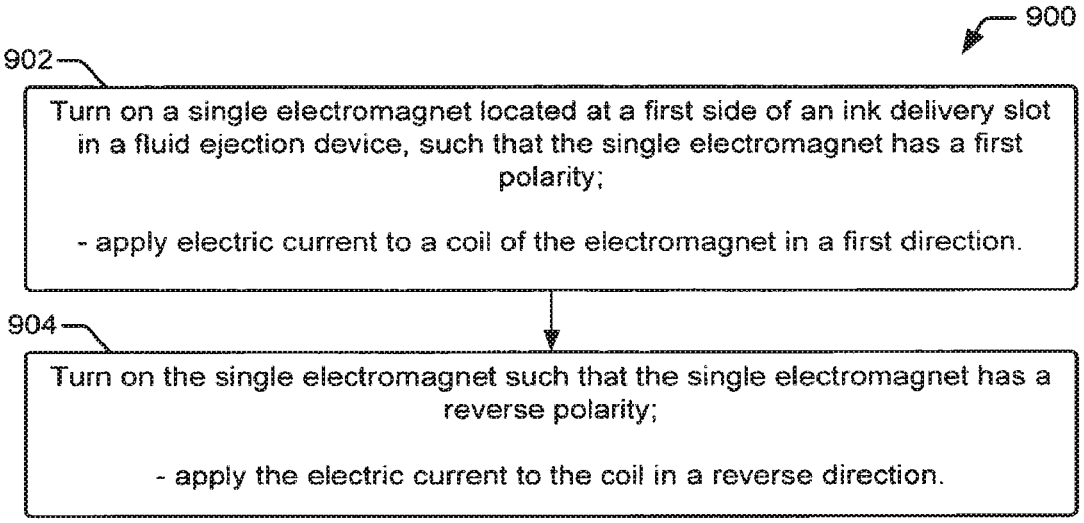

FIGS. 8 and 9, show flowcharts of example methods 800 and 900, related to a fluid ejection device (e.g., a printhead) with mixing beads and electromagnets that function to disrupt pigment settling within the printhead fluid ejection device, according to embodiments of the disclosure. Methods 800 and 900 are associated with the embodiments discussed above with regard to FIGS. 1-7, and details of the steps shown in methods 800 and 900 can be found in the related discussion of such embodiments. The steps of methods 800 and 900 may be embodied as programming instructions stored on a computer/processor-readable medium, such as memory 113 of FIG. 1. In an embodiment, the implementation of the steps of methods 800 and 900 are achieved by the reading and execution of such programming instructions by a processor, such as processor 111 of FIG. 1. Methods 800 and 900 may include more than one implementation, and different implementations of the methods 800 and 900 may not employ every step presented in their respective flowcharts. Therefore, while steps of methods 800 and 900 are presented in a particular order within the flowcharts, the order of their presentation is not intended to be a limitation as to the order in which the steps may actually be implemented, or as to whether all of the steps may be implemented. For example, one implementation of method 800 might be achieved through the performance of a number of initial steps, without performing one or more subsequent steps, while another implementation of method 800 might be achieved through the performance of all of the steps.

Method 800 of FIG. 8, begins at block 802, where the first step shown is to turn on first and second electromagnets in a fluid ejection device to raster a mixing bead back and forth across an ink delivery slot. In this step, the first electromagnet is located at a first side of the ink delivery slot and the second electromagnet is located at a second side of the ink delivery slot. As shown at blocks 804, 806, and 808, respectively, turning on the first and second electromagnets can include turning on the first electromagnet, turning off the first electromagnet, and, upon turning off the first electromagnet, turning on a second electromagnet. As shown at block 810, where the mixing bead is a magnet, turning on the first and second electromagnets can include turning on the first and second electromagnets simultaneously such that the first electromagnet pulls the mixing bead in a first direction while the second electromagnet pushes the mixing bead in the first direction.

Method 900 of FIG. 9, begins at block 902 where the first step shown is to turn on a single electromagnet such that the single electromagnet has a first polarity. The single electromagnet is located at a first side of an ink delivery slot in a fluid ejection device. Turning on the single electromagnet includes applying electric current to a coil of the electromagnet in a first direction. The next step in method 900, as shown at block 904, is to turn on the single electromagnet such that the single electromagnet has a reverse polarity (i.e., an opposite polarity from the first polarity). Turning on the single electromagnet such that the single electromagnet has a reverse polarity includes applying the electric current to the coil in a reverse direction.

What is claimed is:

1. A fluid ejection device comprising:

a die substrate;

a chiclet adhered by a front side thereof to the die substrate;

an ink delivery slot formed through the chiclet from a back side thereof to the front side thereof;

a mixing bead at the back side of the chiclet, adjacent the ink delivery slot; and at least one electromagnet on at least one side of the ink delivery slot to raster the mixing bead back and forth across the ink delivery slot away from and toward the at least one side.

2. A fluid ejection device as in claim 1, wherein the at least one electromagnet comprises two electromagnets, one on each side of the ink delivery slot to raster the mixing bead back and forth across the ink delivery slot through alternating activation of the two electromagnets.

3. A fluid ejection device as in claim 1, wherein the mixing bead comprises a magnet, wherein the at least one electromagnet comprises two electromagnets, one on each side of the ink delivery slot to raster the mixing bead back and forth across the ink delivery slot through simultaneous activation of the two electromagnets.

4. A fluid ejection device as in claim 1, wherein the at least one electromagnet comprises a single electromagnet on one side of the ink delivery slot to raster the mixing bead back and forth across the ink delivery slot through reversing a direction of current flow through a coil of the electromagnet.

5. A fluid ejection device as in claim 3, wherein simultaneous activation of the two electromagnets comprises alternating the polarities of the two electromagnets with each activation.

6. A fluid ejection device as in claim 1, wherein the mixing bead comprises a metal bead.

7. A fluid ejection device as in claim 6, wherein the metal bead is formed of a ferromagnetic material selected from the group consisting of iron, nickel, cobalt, and metal alloy.

8. A fluid ejection device as in claim 1, wherein the mixing bead comprises a magnet.

9. A fluid ejection device as in claim 1, wherein the mixing bead is sized such that the mixing bead cannot enter the ink delivery slot.

10. A fluid ejection device as in claim 1, further comprising a polymer layer coating the mixing bead.

11. A processor-readable medium, storing code representing instructions that when executed by a processor cause the processor to:

turn on first and second electromagnets in a fluid ejection device to raster a mixing bead back and forth across an ink delivery slot away from and toward the first and second electromagnets;

wherein the first electromagnet is located at a first side of the ink delivery slot and the second electromagnet is located at a second side of the ink delivery slot.

12. A processor-readable medium as in claim 11, wherein turning on the electromagnets comprises:

turning on the first electromagnet;

turning off the first electromagnet; and upon turning off the first electromagnet, turning on the second electromagnet.

13. A processor-readable medium as in claim 11, wherein the mixing bead is a magnet, and turning on the electromagnets comprises turning on the first and second electromagnets simultaneously such that the first electromagnet pulls the mixing bead in a first direction toward the first electromagnet while the second electromagnet pushes the mixing bead in the first direction away from the second electromagnet.

14. A processor-readable medium storing code representing instructions that when executed by a processor cause the processor to:

turn on a single electromagnet located at a first side of an ink delivery slot in a fluid ejection device, such that the single electromagnet has a first polarity; and turn on the single electromagnet such that the single electromagnet has a reverse polarity, wherein turning on the single electromagnet to have the first polarity and turning on the single electromagnet to have the reverse polarity is to raster a mixing bead back and forth across the ink delivery slot away from and toward the single electromagnet.

15. A processor-readable medium as in claim 14, wherein:

turning on the single electromagnet to have the first polarity comprises applying electric current to a coil of the electromagnet in a first direction; and turning on the single electromagnet to have the reverse polarity comprises applying the electric current to the coil in a reverse direction.

* * * * *